US005301795A

United States Patent [19]

Persson

[11] Patent Number: 5,301,795

[45] Date of Patent: Apr. 12, 1994

[54] CONVEYOR FOR FRESH BOXLESS SAND MOULDS

[75] Inventor: Viggo Persson, Nivå, Denmark

[73] Assignee: Dansk Industri Syndikat A/S, Denmark

[21] Appl. No.: 24,249

[22] Filed: Mar. 1, 1993

[30] Foreign Application Priority Data

Mar. 25, 1992 [DK] Denmark ..... 0392/92

[51] Int. Cl.[5] ..... B65G 25/00

[52] U.S. Cl. ..... 198/773; 198/774.1; 198/774.3

[58] Field of Search ..... 198/773, 774.1, 774.2, 198/774.3, 774.4, 775, 776, 777; 414/750

[56] References Cited

U.S. PATENT DOCUMENTS

| | | | |
|---|---|---|---|
| 1,942,538 | 1/1934 | Cutler | 198/774.3 X |
| 3,455,433 | 7/1969 | Gentry | 198/774.3 X |
| 3,489,263 | 1/1970 | Gentry | 198/774.1 |
| 3,576,246 | 4/1971 | Hulet et al. | 164/324 X |
| 3,881,595 | 5/1975 | Deve | 198/774.2 X |
| 4,061,231 | 12/1977 | Birdwell | 198/774.2 X |
| 4,337,857 | 7/1982 | Schneider | 198/773 |
| 4,540,036 | 9/1985 | Jensen | 164/323 |
| 4,569,437 | 2/1986 | Doerges | 198/773 |
| 4,653,344 | 3/1987 | Nelson | 198/774.3 X |
| 4,830,178 | 5/1989 | de Vries | 198/774.3 |

FOREIGN PATENT DOCUMENTS

| | | | |
|---|---|---|---|
| 119373 | 3/1971 | Denmark . | |
| 127494 | 4/1974 | Denmark . | |
| 1965945 | 12/1971 | Fed. Rep. of Germany . | |
| 3416019 | 6/1985 | Fed. Rep. of Germany . | |
| 3613845 | 11/1987 | Fed. Rep. of Germany . | |
| 3829305 | 9/1990 | Fed. Rep. of Germany . | |
| 2560169 | 8/1985 | France | 198/774.1 |
| 0513908 | 5/1976 | U.S.S.R. | 198/774.2 |

*Primary Examiner*—James R. Bidwell
*Attorney, Agent, or Firm*—Larson and Taylor

[57] ABSTRACT

A step conveyor for fresh boxless sand moulds includes at least two sets of interdigitating parallel bars adapted to support and move the sand moulds. The top of each bar is covered or coated by a layer of a material with a considerably lower thermal conductivity than that of steel. In a specific embodiment, a top rail is secured to a base member by screws, and this top rail is made of a suitable synthetic resin, such as low-pressure polyethylene with ultra-high molecular weight. With this arrangement, the tendency for moisture from the fresh sand moulds to condense on the conveyor bars is considerably reduced or eliminated, thus reducing or eliminating the tendency for sand from the moulds to adhere to the conveyor bars.

6 Claims, 2 Drawing Sheets

CONVEYOR FOR FRESH BOXLESS SAND MOULDS

TECHNICAL FIELD

The present invention relates to a conveyor for fresh boxless sand moulds or mould parts, said conveyor being of the kind set forth in the preamble of claim 1.

BACKGROUND ART

Conveyors of the kind referred to initially are used extensively in foundries, examples being described in DK Patent Specifications Nos. 119,373 and 127,494 as well as in the DE Published Patent Application No. 3,613,845 and in U.S. Pat. No. 4,540,036.

In conveyors of this kind, the bars used for supporting and moving the moulds or mould parts are normally made of steel. As the sand moulds or mould parts are hot and moist, water will condense on the bars, causing a build-up of sand due to the adhesive properties of the binders used in the mould sand.

This may lead to that the moulds are lifted slightly from the conveyor bars, in many cases causing offset between the parts of the finished casting.

DISCLOSURE OF THE INVENTION

It is the object of the present invention to provide a conveyor of the kind referred to initially, in which problems caused by condensation of water on the conveyor bars are eliminated or at least considerably reduced, and this object is achieved with a conveyor, according to the wherein the surfaces of the bars adapted to face the moulds or mould parts are covered or coated with a layer of a material having substantially lower thermal conductivity than that of steel.

With this arrangement, the low thermal conductivity of the material facing the moulds prevents condensation of water from the vapour emitted by the moulds, as this vapour will quickly heat the surface of this material up above the condensation temperature. Hence, these surfaces will remain dry, and the risk of sand adhering to them is eliminated or considerably reduced.

Advantageous embodiments of the conveyor according to the present invention, the effects of which are explained in more detail in the following detailed portion of the present specification, including providing that the coefficient of friction between the material and the material of the sand moulds or mould parts is at least of the same order of magnitude as that between steel and the material of said sand moulds or mould parts. Further, the material used for the covering or coating is selected so as to exhibit at least one of the following properties: a) non-corrosiveness in relation to steel, b) high wear resistance, c) high impact strength, d) low physical affinity towards the binders or solvents used in the sand moulds or mould parts, and e) substantially constant physical, including thermal, properties up to temperatures of at least 100° C. In addition, the material preferably comprises a synthetic resin material, Further, the conveyor is preferably of the kind comprising at least two further sets of bars extending substantially parallel to the first-mentioned sets of bars and adapted to engage the sides of the sand moulds or mould parts, wherein the surfaces of the second sets of bars are also covered or coated by a layer of material having substantially lower thermal conductivity than steel. Additionally, in one preferred embodiment, the layer of material is constituted by a profiled member made of the material and secured to the remainder of each bar by means of scares or rivets, by being cemented or cast-on, by welding under pressure or by means of a dovetail joint or other mechanical engagement or securing means.

BRIEF DESCRIPTION OF THE DRAWINGS

In the following detailed portion of the present specification, the present invention will be explained in more detail with reference to the drawings, in which.

DESCRIPTION OF THE PREFERRED EMBODIMENTS

Figure 2:
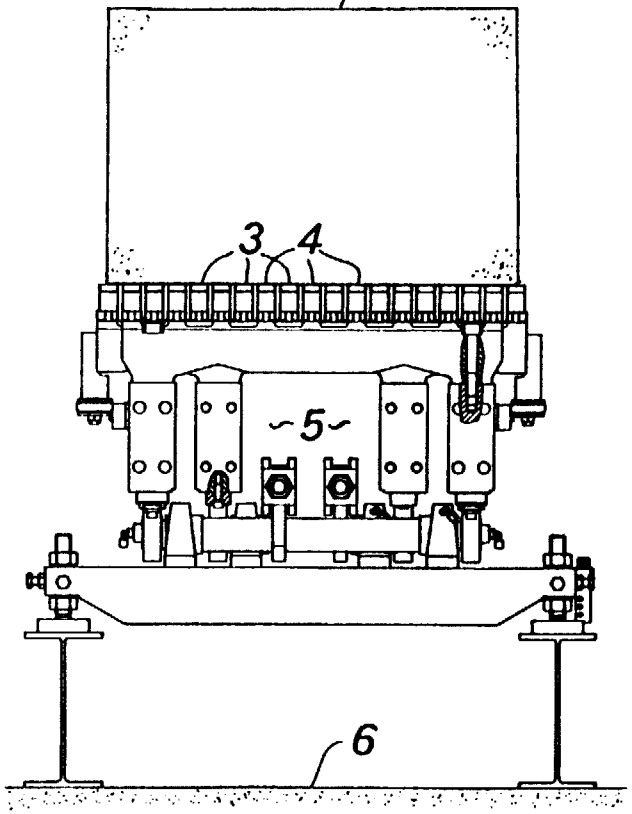
FIG. 2 is an end view of the conveyor part shown in FIG. 1, FIG. 3 on an enlarged scale shows a conveyor bar used in the conveyor shown in FIGS. 1 and 2.
Figure 1:
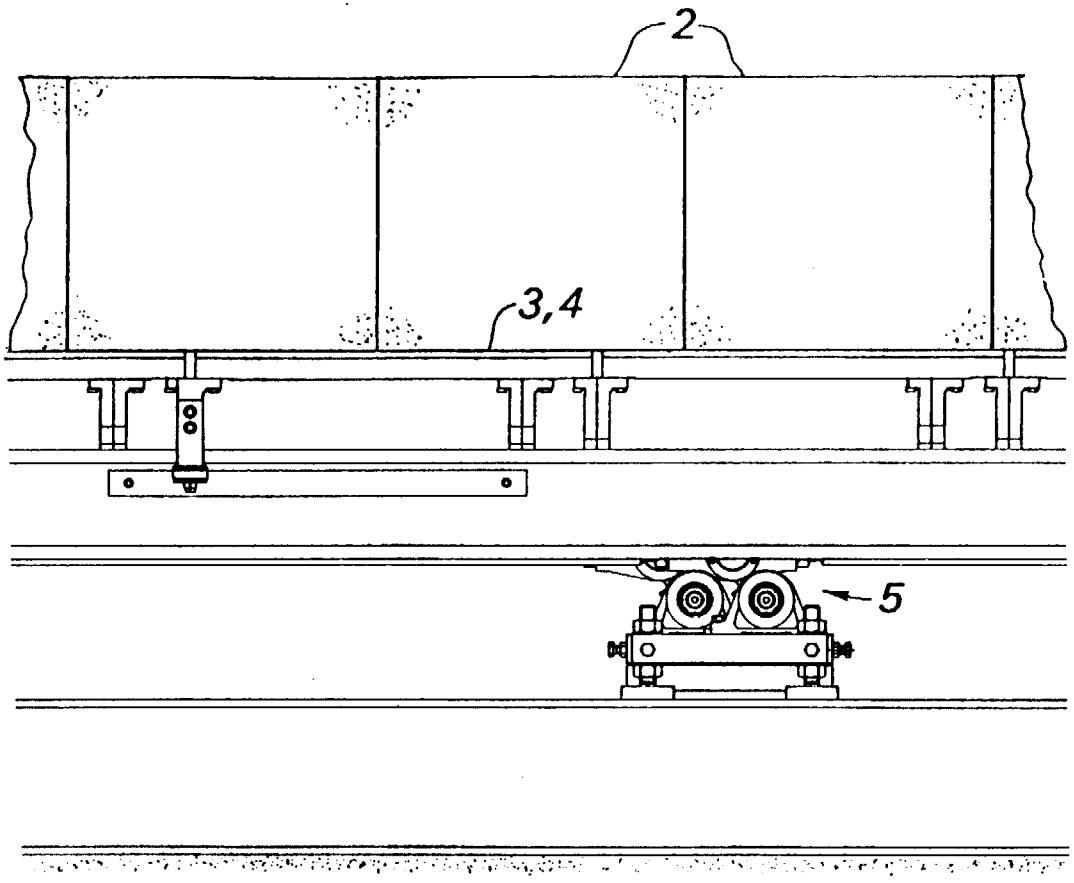
FIG. 1 is a side view of a part of a conveyor according to the present invention.

The step conveyor 1 shown in FIGS. 1 and 2 comprises as its supporting means adapted to support and convey a train or string of boxless sand mould parts 2 two sets of bars 3 and 4, alternating with each other across the conveyor as shown in FIG. 2.

By means of a lifting and moving mechanism 5 the two sets of bars 3 and 4 are alternately lifted and lowered in such a manner, that at any moment at least one of these sets will support the sand mould parts 2 at a substantially constant height relative to the foundry floor 6. Further, the lifting and moving mechanism 5 is adapted to move at least one of the sets of bars 3 and 4 through a limited distance in the conveying direction whilst at the same time supporting the sand mould parts 2, so that the latter will be moved a step forward. The principle, according to which the step conveyor 1 functions, is well-known, e.g. from DK Patent Specification No. 127,494, DE Published Specification No. 3,613,845 and U.S. Pat. No. 4,540,036, for which reason the lifting and moving mechanism 5 need not be described in detail in order to explain the present invention.

Figure 3:
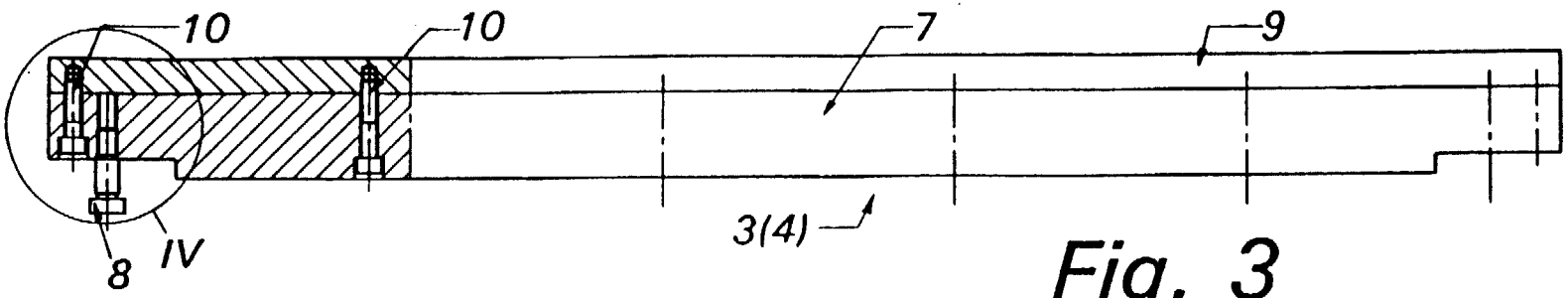

The bar 3 (or 4) shown in FIG. 3 consists of a base member 7 made of steel with similar properties as the steel used for making conventional all-steel bars for a step conveyor of the type referred to. The base member 7 is adapted to be secured to the lifting and moving mechanism 5 by means of screws 8.

The top of the base member 7 is covered by a top rail 9 of a suitable material. In the present context, the expression "suitable" implies a desire for as many as possible of the qualities referred to in the following paragraphs.

One of these qualities is a thermal conductivity considerably lower than that of steel; this reduces or removes the tendency of humidity from the hot and moist sand moulds from condensing on the bars and causing a build-up of sand on them due to the adhesive properties of the binders used in the sand moulds.

A further one of these qualities is a coefficient of friction towards the material of the sand mould parts 2 at least of the same order of magnitude as that of steel; in this way, slipping between the bars 3,4 and the sand mould parts 2 is reduced or avoided—this is especially of importance, when the conveyor is used for conveying mould parts against means offering some resistance with a view to pressing the mould parts together.

Further, the following properties are highly desirable in the material used for the top rails 9:

a) non-corrosiveness in relation to steel,
b) high wear resistance,
c) high impact strength,
d) low physical affinity towards binders or solvents used in said sand moulds or mould parts, and
e) substantially constant physical properties up to temperatures of at least 100° C.

The advantages of having these properties are obvious, and need no further explanation.

As examples of materials that may be used for making the top rails 9 or for a coating intended to play a similar role, the following may be mentioned:

Low-pressure polyethylene of ultra-high molecular weight, marketed under the trade name "Solidur 1000" by the Solidur Deutschland GmbH & Co. KG, and Polyurethane casting resin marketed under the trade name "Sadocast 537" by the Danish firm Sadofoss of Fredensborg, Denmark, this material being cast on top of the base members 7 in a layer 11 with a thickness of the order of 3 mm.

Figure 4:
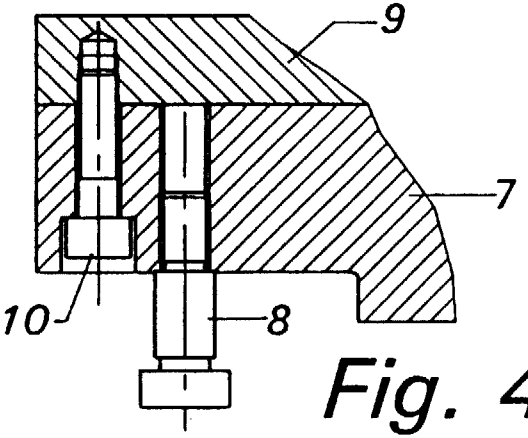
FIG. 4 is a further enlarged sectional view showing the part indicated at IV in FIG. 3, and FIG. 5 on the same scale as FIG. 3 shows a second examplary embodiment of a conveyor bar that may be used in the conveyor shown in FIGS. 1 and 2 instead of the bar shown in FIGS. 3 and 4.

In the case of the polyethylene material, the material has been formed into rails like the top rail 9 shown in FIGS. 3 and 4 and secured to the base members 7 by means of the screws 10 likewise shown in FIGS. 3 and 4. In the course of time, these rails may, however, be deformed slightly and hence produce problems with regard to maintaining the permitted height tolerance.

Figure 5:
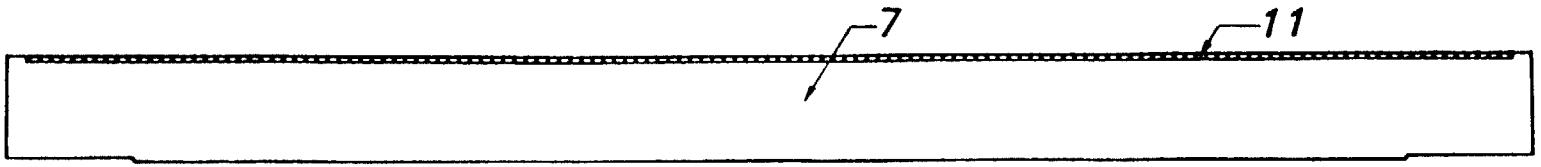

The problem of maintaining the permitted height tolerance is considerably less when using polyurethane resin which has been cast on top of the base members 7 in the form of a thin layer 11 as shown in FIG. 5. In this case it is, of course, necessary that the material adheres to the base member, and this condition seems to be fulfilled by the material "Sadocast 537" mentioned above.

Other materials than synthetic resins could also be contemplated for use in forming the top rails 9 or the layer 11 on top of the base members 7, such as glass-bonded mica of the type marketed under the trade name "Muratherm 500" from Murtfeldt GmbH & Co. KG, Germany. There is, however, a possibility that the friction coefficient of this material may be too low in certain cases. An increased coefficient of friction may also be achieved by profiling or otherwise forming a pattern in the surface of the top rail 9 or the cast-on layer 11. In any case, it will be necessary to find a compromise between rigidity and strength on the one hand and thermal insulating ability on the other hand.

In the example described with reference to the drawings, the invention has been explained as used on step conveyors of the type comprising solely two or more sets of bars adapted to support the weight of the sand moulds or mould parts. The principles of the invention may, however, be applied with the same desirable effect in conveyors of the kind comprising at least two second sets of bars extending substantially parallel to said first-mentioned set of bars and adapted to engage the sides of said sand moulds or mould parts. Such conveyors are also disclosed in the above mentioned DE and US patent documents, for which reason a more detailed explanation is considered unnecessary.

I claim:

1. A conveyor for fresh boxless sand moulds or mould parts and of the kind comprising at least two sets of bars adapted to support said moulds or mould parts alternately, at least one set of said two sets of bars being adapted to move in the direction of conveying while supporting said moulds or mould parts and the surface of said bars adapted to face said moulds or mould parts being covered or coated by a layer of a material having substantially lower thermal conductivity than that of steel.

2. Conveyor according to claim 1, wherein the coefficient of friction between said material and the material of said sand moulds or mould parts is at least of the same order of magnitude as that between steel and the material of said sand moulds or mould parts.

3. Conveyor according to claim 1, wherein said material (9,11) used for said covering or coating is selected so as to exhibit at least one of the following properties:

a) non-corrosiveness in relation to steel,
b) high wear resistance,
c) high impact strength,
d) low physical affinity towards binders or solvents used in said sand moulds or mould parts, and
e) substantially constant physical, including thermal, properties up to temperatures of at least 100° C.

4. Conveyor according to claim 1, wherein said material comprises a synthetic resin material.

5. Conveyor according to claim 1, and of the kind comprising at least two further sets of bars extending substantially parallel to said at least two sets of bars and adapted to engage the sides of said sand moulds or mould parts, wherein the surfaces of said two further sets of bars are also covered or coated by a layer of material having substantially lower thermal conductivity than that of steel.

6. Conveyor according to claim 1, wherein said layer of material is constituted by a profiled member made of said material and secured to the remainder of each bar by means of scenes or rivets, by being cemented or cast-on, by welding under pressure or by means of a dovetail joint or other mechanical engagement or securing means.

* * * * *